US007022742B2

(12) United States Patent
Inga

(10) Patent No.: US 7,022,742 B2
(45) Date of Patent: Apr. 4, 2006

(54) PROCESS TO CONTROL NITROGEN-CONTAINING COMPOUNDS IN SYNTHESIS GAS

(75) Inventor: Juan Inga, Sapulpa, OK (US)

(73) Assignee: Syntroleum Corporation, Tulsa, OK (US)

( * ) Notice: Subject to any disclaimer, the term of this patent is extended or adjusted under 35 U.S.C. 154(b) by 93 days.

(21) Appl. No.: 10/820,585

(22) Filed: Apr. 8, 2004

(65) Prior Publication Data

US 2005/0228060 A1 Oct. 13, 2005

(51) Int. Cl.
*C07C 27/00* (2006.01)
*C10G 17/00* (2006.01)

(52) U.S. Cl. ..... 518/700; 518/702; 518/703; 518/715; 208/254 R

(58) Field of Classification Search ..... 518/700, 518/702, 703, 715; 208/254 R
See application file for complete search history.

(56) References Cited

U.S. PATENT DOCUMENTS 4,002,721 A 1/1977 Guffy et al.
4,007,129 A 2/1977 Naber et al.
4,011,066 A 3/1977 Bratzler et al.
4,020,144 A 4/1977 Bosniack
4,088,735 A 5/1978 Bratzler et al.
4,100,257 A 7/1978 Sartori et al.
4,112,051 A 9/1978 Sartori et al.
4,155,985 A 5/1979 Doerges
4,155,988 A 5/1979 Karwat et al.
4,189,307 A 2/1980 Marion
4,192,854 A 3/1980 Harvey et al.
4,240,922 A 12/1980 Sartori et al.
4,240,923 A 12/1980 Sartori et al.
4,271,133 A 6/1981 Tellis
4,320,100 A 3/1982 Engelbrecht et al.
4,521,387 A 6/1985 Broecker et al.
4,540,552 A 9/1985 Ream et al.
4,572,826 A 2/1986 Moore
4,624,837 A 11/1986 Baker
4,624,838 A 11/1986 Pan et al.
4,654,148 A 3/1987 Baker
4,693,873 A 9/1987 Baker
4,704,137 A 11/1987 Richter
4,705,673 A 11/1987 Capobianco et al.
4,711,648 A 12/1987 Konkol et al.
4,769,224 A 9/1988 van Grinsven et al.
4,778,484 A 10/1988 Najjar et al.
4,810,475 A 3/1989 Chu et al.
5,068,254 A 11/1991 Posthuma et al.
5,112,586 A 5/1992 Baker
5,403,366 A 4/1995 Leininger et al.
5,415,673 A 5/1995 Hilton et al.
5,720,785 A 2/1998 Baker
5,720,901 A 2/1998 De Jong et al.
5,762,885 A 6/1998 Debbage et al.
5,852,061 A 12/1998 Alexion et al.
5,948,378 A 9/1999 Koveal et al.
5,968,465 A 10/1999 Koveal et al.

(Continued)

*Primary Examiner*—J. Parsa
(74) *Attorney, Agent, or Firm*—Baker & McKenzie LLP; Valerie K. Friedrich

(57) ABSTRACT

A process to control the amount of N-contaminant is synthesis gas which is fed into a Fischer-Tropsch reactor and which utilizes Fischer-Tropsch produced water is provided. A process which utilizes a countercurrent flow of Fischer-Tropsch produced water produced in a downstream Fischer-Tropsch reactor to wash syngas being fed to an upstream Fischer-Tropsch reactor is provided.

19 Claims, 2 Drawing Sheets

U.S. PATENT DOCUMENTS 6,063,349 A 5/2000 Koveal, Jr. et al.
6,107,353 A 8/2000 Koveal et al.
6,162,373 A 12/2000 Koveal, Jr.
6,277,345 B1 8/2001 Stankowiak et al.
6,284,807 B1 9/2001 Leviness et al.
6,458,857 B1 10/2002 Wittenbrink et al.
6,635,171 B1 10/2003 Rosenbaum et al.
6,794,417 B1 * 9/2004 O'Beck et al. ..... 518/700

* cited by examiner

PROCESS TO CONTROL NITROGEN-CONTAINING COMPOUNDS IN SYNTHESIS GAS

CROSS REFERENCE TO RELATED APPLICATIONS

Not applicable.

FEDERALLY SPONSORED RESEARCH

Not applicable.

REFERENCE TO MICROFICHE APPENDIX

Not applicable.

FIELD OF THE INVENTION

The invention relates to a process to control the amount of nitrogen-containing compounds present in the synthesis gas feed to a Fischer-Tropsch process, and more particularly, to the use of a countercurrent flow of Fischer-Tropsch produced water to control nitrogen-containing compounds in an upstream Fischer-Tropsch reactor.

BACKGROUND OF THE INVENTION

Synthesis gas ("syngas") typically contains trace nitrogen-containing compounds, principally ammonia and hydrogen cyanide. Other reactive nitrogen compound species, such as cyanogen and nitrogen oxides, may also be present in very small amounts. Collectively, these nitrogen-containing compounds are referred to herein as N-contaminants.

N-contaminants arise from the presence of one or more nitrogen-containing species in the feed to the synthesis gas generator. For example, $N_2$ may be present in: (1) the feed natural gas; (2) the $O_2$ feed after air separation for an oxygen blown syngas generation process; and/or (3) the air or oxygen-enriched air feed for an air blown process. In addition to or alternatively to these sources of $N_2$, nitrogen-containing hydrocarbon species (especially for liquid and/or solid syngas generation feedstocks, such as residual oil or coal) may also be present in the syngas generator. The concentration of N-contaminants produced in the syngas generator may also be increased substantially through the recycle of Fischer-Tropsch tail gas into the syngas generation process. Similarly, the concentration of N-contaminants produced in the syngas generator may also be increased by recycling of tail gases from other processes into the syngas generator.

Virtually all commercially practiced and proposed syngas generation processes operate at extremely high temperatures, generally in the range of 1500°–2500° F., where the majority of the chemical reactions occur near or at chemical thermodynamic equilibrium. Under these conditions, small quantities of hydrogen cyanide (HCN) and ammonia ($NH_3$) are typically produced. Yet smaller amounts of other reactive nitrogen-containing compounds, such as cyanogen, may also be produced. The amounts of HCN and $NH_3$ in a syngas depends strongly on both the nitrogen concentration in the syngas generator feed and the process conditions, particularly pressure and temperature. Typical concentrations of these nitrogen-containing compounds in the syngas generator outlet stream which has not been further processed (referred to herein as a "raw synthesis gas") are in the range from about 1 to about 50 vppm HCN and from about 5 to about 1000 vppm $NH_3$. Generally, the raw syngas contains between about 10 and about 30 times more $NH_3$ than HCN.

Ammonia, which is basic, is very soluble in water. Raw syngases contain both carbon dioxide and water vapor and at least about 90 wt % of the ammonia present in the raw syngas can be removed by cooling the raw synthesis gas to less than about 200° F. and condensing the produced water. $CO_2$ dissolved in the condensed water will facilitate dissolution of the ammonia from the synthesis gas. The amount of ammonia in the syngas may be further decreased by use of a water scrubber.

HCN, on the other hand, is much less water soluble than $NH_3$, and is somewhat acidic in solution. Therefore, HCN is much more difficult to remove by means of raw synthesis gas water knockouts and/or subsequent scrubbing. Removal by water scrubbing requires relatively large quantities of water, typically greater than 1:1 water:syngas mass ratios. Incremental HCN removal can be realized by recirculating the ammonia-containing wash water, produced by scrubbing the ammonia from the raw syngas which contributes to HCN disassociation and removal by water scrubbing. However, HCN removal with water scrubbing is inefficient, requiring excessive amounts of water in relation to the HCN quantity removed. A large number of known processes for HCN removal from synthesis gases, including HCN adsorption, catalytic conversion of HCN (hydrogenation and/or hydrolysis), and chemically treated water scrubbing of HCN are known. Other processes attempt to prevent the formation of HCN by upstream removal of $N_2$ from natural gas. Such known processes, however, result in or require increased plant capital and/or operating costs, supply and disposal of treatment chemicals, and/or potential contamination of the treated synthesis gas. Moreover, may of these processes are hampered by the presence of other acidic materials, e.g. $CO_2$.

Removal of HCN and $NH_3$ from syngas is considered important because these nitrogen-containing compounds are poisons of Fischer-Tropsch catalysts, particularly non-shifting catalysts, and more particularly, those Fischer-Tropsch catalysts containing cobalt.

SUMMARY OF THE INVENTION

Embodiments of the invention provide a process to remove N-contaminants from a synthesis gas stream including the steps of introducing a syngas stream and a water stream into a first absorber, recovering overhead from the first absorber a first-washed syngas stream, and introducing the first-washed syngas stream into a second absorber. A Fischer-Trospsch produced water stream is also introduced into the second absorber. Finally, a second-washed syngas stream is recovered from the overhead of the second absorber.

In other embodiments of the invention, the second-washed syngas stream is used as a feed for a Fischer-Tropsch reactor. In some embodiments of the invention, the Fischer-Tropsch reactor utilizes a catalyst comprising cobalt.

In some embodiments of the invention, the syngas stream is generated in the presence of air or oxygen enriched air.

Yet other embodiments of the invention provide a Fischer-Tropsch process including the steps of feeding a syngas into a first stage Fischer-Tropsch reactor and recovering a first overhead stream which contains Fischer-Tropsch water, hydrocarbon product and unreacted syngas, separating the unreacted syngas from the first overhead stream and feeding such unreacted syngas into a second stage Fischer-Tropsch reactor. A second overhead stream, which contains Fischer-Tropsch water, hydrocarbon product and unreacted syngas, is recovered from the second stage Fischer-Tropsch reactor, and the Fischer-Tropsch produced water is separated from the second overhead stream. The separated Fischer-Tropsch water is mixed with the first overhead stream.

In some embodiments of the invention, the Fischer-Tropsch produced water is mixed with the first overhead stream before the unreacted syngas is separated from the first overhead stream. In yet other embodiments, the mixing of the Fischer-Tropsch produced water with the first overhead stream occurs simultaneously with the separation of the unreacted syngas from the first overhead stream.

In yet other embodiments of the invention, Fischer-Tropsch produced water is separated from the first overhead stream and is mixed with a raw syngas in an absorber to produce a washed syngas. In some embodiments of the invention, the washed syngas is used as a feed syngas to a first stage Fischer-Tropsch reactor

DESCRIPTION OF EMBODIMENTS OF THE INVENTION

The Fischer-Tropsch reaction for converting syngas, which is composed primarily of carbon monoxide (CO) and hydrogen gas ($H_2$), is well known and may be characterized by the following general reaction:

$$2nH_2+nCO\rightarrow(\text{—}CH_2\text{—})_n+nH_2O \quad (1)$$

Non-reactive components, such as nitrogen, may also be included or mixed with the syngas. This may occur in those instances where air, enriched air, or some other non-pure oxygen source is used during the syngas formation. The water produced according to Equation (1) above is referred to herein as "Fischer-Tropsch produced water" or as "FT produced water." The hydrocarbon product of the Fischer-Tropsch reaction, as seen in Equation (1), is primarily composed of paraffins and olefins, with small amounts of oxygenates.

Figure 1:
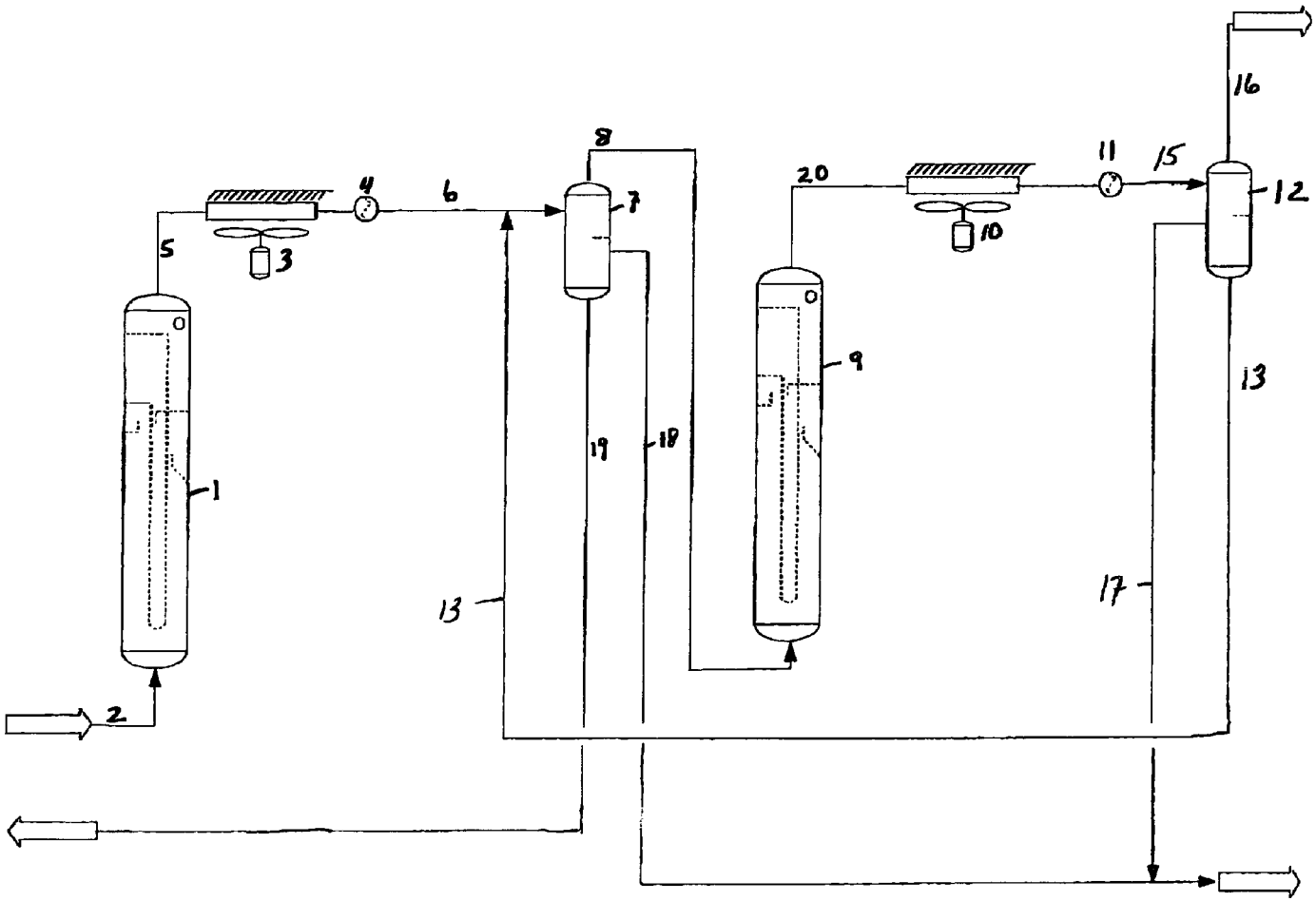
FIG. 1 is a schematic of a first embodiment of the process of the invention.

Referring to FIG. 1, syngas 2 is fed into a first Fischer-Tropsch reactor ("FTR") 1. An overhead stream 5 is cooled using an aircooler 3 and optionally a water cooler 4. The cooled Fischer-Tropsch overhead stream 6 enters a first separator 7 where light hydrocarbons 18 and FT produced water 19 are separated. Overhead gases 8, which contain primarily unreacted syngas, enter a second FTR 9. A second Fischer-Tropsch stream 20 is recovered overhead from second FTR 9 and cooled by aircooler 10 and optionally further cooled by a water cooler or chiller 11. The condensed hydrocarbons 17 and FT produced water 13 present in the cooled second Fischer-Tropsch stream 15 are separated in a second separator 12. A tailgas stream 16 may also be withdrawn from second separator 12. The tailgas 16 may then be used to fuel a turbine to produce power or may be passed into a third stage FTR to produce more hydrocarbon product. Alternatively, tailgas 16 may be otherwise recycled or disposed.

Referring still to FIG. 1, the FT produced water 13, which was produced in second FTR 9 and collected in separator 12, is fed into and mixed with the cooled Fischer-Tropsch overhead stream 6 from first FTR 1. This mixing may be aided by the presence of an inline mixer or other appropriate mixing device, a number of which known.

In some embodiments of the invention more than two FTRs may be used. In such embodiments, a water stream produced in an FTR may be cooled, separated and passed to one or more cooled product overhead streams from one or more FTRs upstream of the FTR in which the cooled water stream was produced. For example, a stream of Fischer-Tropsch water produced in a third stage FTR could be fed to the cooled second Fischer-Tropsch overhead stream 15.

In yet other embodiments of the invention, the FT produced water 19 from the overhead separator 7 of first FTR 1 may be used to do a final rinse of syngas 2 upstream of the FTR 1. That is, the FT produced water made in any of the FTRs may be recovered, separated and fed upstream, i.e. countercurrent, to wash an FTR feed stream.

Figure 2:
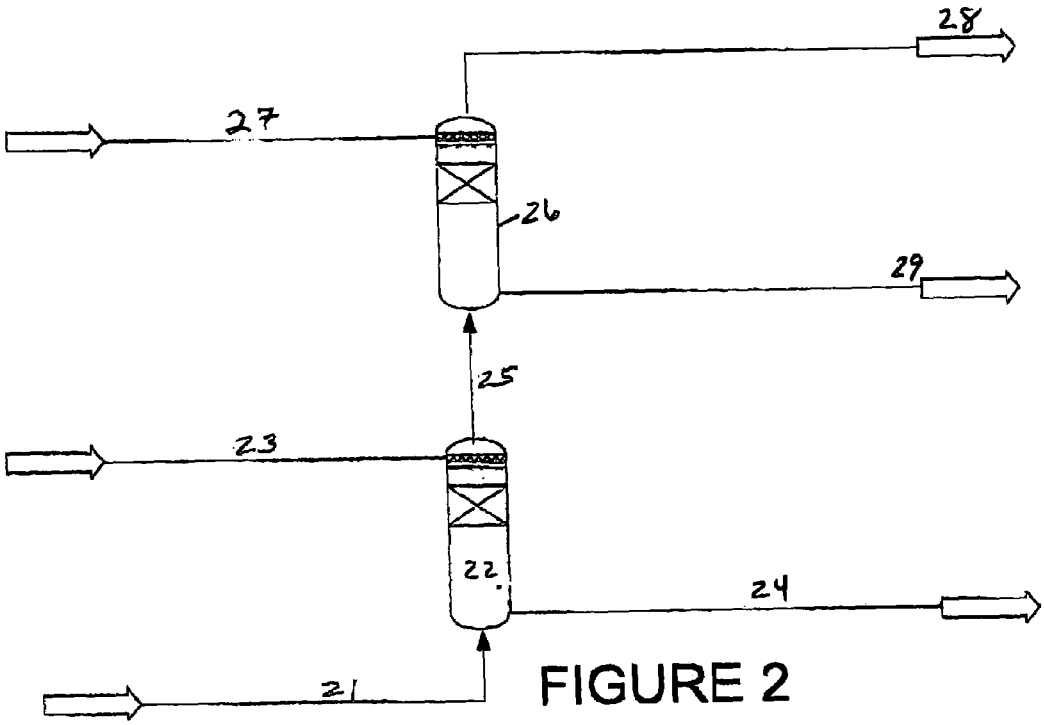
FIG. 2 is a schematic of a first embodiment of the absorption system for use in the process of the invention.

Referring now to FIG. 2, a cooled raw syngas 21 is first washed in an absorber 22 with a water stream 23 that comes from a stripper column, or other water source, such as a makeup water supply. Raw syngas 21 may optionally be compressed prior to being washed in absorber 22. N-contaminants in raw syngas 21 are absorbed, in part, by the water stream 23. The absorbed N-contaminants exit the absorber 22 in a nitrogen-enriched aqueous stream 24, which may be sent to a stripper column wherein the nitrogen-containing compounds are separated from the water. The first washed syngas stream 25 may still contain low levels of $NH_3$, HCN and other N-contaminants.

Syngas stream 25 may be further washed in second absorber 26 using Fischer-Tropsch produced water 27. Fischer-Tropsch produced water 27 typically contains very small amounts of $NH_3$ and is acidic. Therefore, the Fischer-Tropsch produced water may facilitate the absorption of $NH_3$ present in the syngas. The two-times washed syngas 28 may then be fed into a Fischer-Tropsch reactor. The nitrogen-enriched aqueous stream 29 recovered from the second absorber 26 may be sent to a wastewater treatment process. Alternatively, the nitrogen-enriched aqueous streams 24 and/or 29 may be treated to remove nitrogen containments and recycled to the process. In some embodiments of the process, either or both of water stream 23 and Fischer-Tropsch produced water 27 may be temperature controlled to improve or modify the amount of nitrogen containments absorbed by such streams.

In some embodiments of the process, the overhead effluent from first FTR 1 is not passed through either aircooler 3 or water cooler 4. In such embodiments, FT produced water 13 recovered from second separator 12 is cooled prior to being mixed with overhead stream 5. Water stream 13 may be cooled using any of a number of known methods. In some embodiments, water stream 13 is cooled by shell and tube water coolers. In some embodiments of the invention, Fischer-Tropsch produced water may be used as the wash water in one or both of the first and second absorbers 22 and 26.

In yet other embodiments of the invention, absorbers 22 and 26 may be combined in a single vessel, with each absorber serving as a separate absorption zone within the vessel. In such embodiments, a bottom plate may be placed between the two absorption zones.

Figure 3:
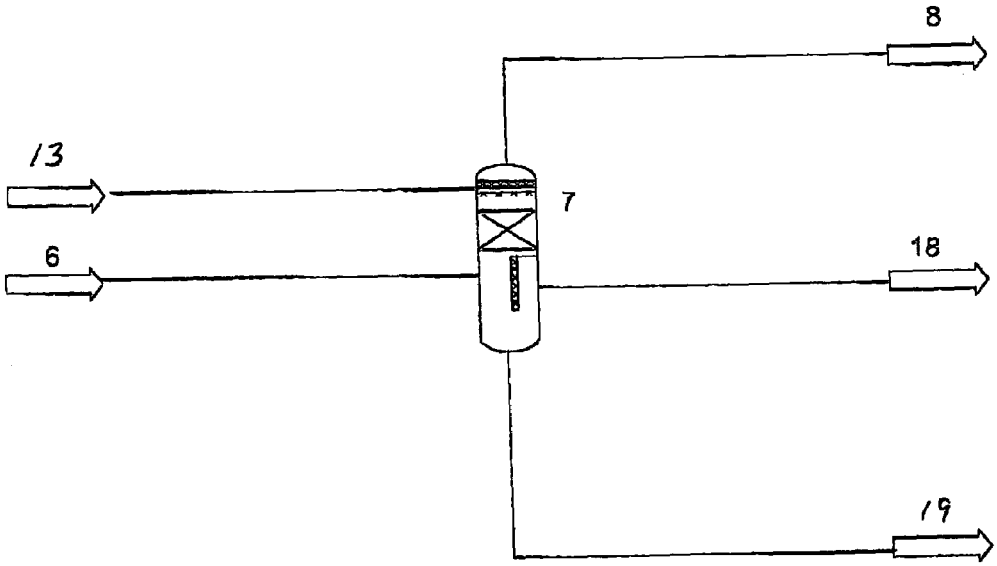
FIG. 3 is a schematic of a second embodiment of the absorption system for use in the process of the invention.

Referring to FIG. 3, another alternative embodiment is shown in which the Fischer-Tropsch produced water 13 from second separator 12 is introduced directly into first separator 7, without prior mixing with the cooled overhead stream 6. Because water stream 13 is introduced above the gas/liquid separation, first separator 7 will behave as an absorber.

Fischer-Tropsch produced water generally contains about 1 to 2 wt % of dissolved hydrocarbon oxygenates, including, for example, alcohols, ketones and acids. Such hydrocarbon oxygenates would enter either or both of absorbers 22 and 26, i.e. whichever absorbers in which FT produced water is used. Upon contact with the syngas stream, some or all such oxygenates may be vaporized and thus, exit the overhead of the absorber. Because the overhead of the final absorber is fed to an FTR, all or part of such oxygenates may be recovered in embodiments of the invention. For example, where FT produced water is used only in second absorber 26, all or part of the oxygenates may exit with two-times washed syngas stream 28 which is then fed into an FTR, most typically FTR 1.

While presently preferred embodiments of the invention have been given for the purpose of disclosure, numerous changes in the details of construction, arrangements of parts and operation of the process can be made which will readily suggest themselves to those skilled in the art and which are encompassed within the spirit of the invention and the scope of the appended claims.

What is claimed is:

1. A process to remove N-contaminants from a syngas stream comprising the steps of:

(a) introducing a syngas stream and a water stream into a first absorber;

(b) recovering a first-washed syngas stream overhead from the first absorber;

(c) introducing the first-washed syngas stream and a Fischer-Tropsch produced water stream into a second absorber; and (d) recovering a second-washed syngas stream overhead from the second absorber.

2. The process of claim 1 further comprising the step of:

(e) using the second-washed syngas stream as a feed for a first stage Fischer-Tropsch reactor.

3. The process of claim 2 wherein the first stage Fischer-Tropsch reactor contains a catalyst comprising cobalt.

4. The process of claim 1 wherein the syngas is generated in a the presence of air or oxygen-enriched air.

5. A Fischer-Tropsch process comprising the steps of:

(a) introducing a feed syngas stream into a first-stage Fischer-Tropsch reactor and recovering a first overhead stream comprised of Fischer-Tropsch produced water, hydrocarbon product and unreacted syngas from the first stage Fischer-Tropsch reactor;

(b) separating the unreacted syngas component from the first overhead stream and introducing the unreacted syngas component into a second stage Fischer-Tropsch reactor;

(c) recovering a second overhead stream comprised of Fischer-Tropsch produced water and hydrocarbon product from the second stage Fischer-Tropsch reactor;

(d) separating the Fischer-Tropsch produced water from the second overhead stream; and (e) mixing the Fischer-Tropsch produced water separated in step (d) with the first overhead stream.

6. The process of claim 5 wherein the mixing step (e) occurs prior to the separation step (b).

7. The process of claim 5 wherein the mixing step (e) occurs simultaneously with the separation step (b).

8. The process of claim 5 further comprising the steps of:

(i) separating the Fischer-Tropsch produced water from the first overhead stream;

(ii) feeding the Fischer-Tropsch produced water separated in step (i) and a raw syngas stream into a first absorber; and (iii) recovering a washed syngas stream from the first absorber.

9. The process of claim 8 wherein the washed syngas stream from the first absorber is used as the feed syngas stream in step (a).

10. The process of claim 5 wherein the first and second stage Fischer-Tropsch reactors contain a catalyst comprising cobalt.

11. The process of claim 5 wherein the syngas stream is produced in the presence of air or oxygen-enriched air.

12. In a Fischer-Tropsch process wherein a synthesis gas is catalytically converted into a Fischer-Tropsch reaction product mixture and wherein two or more Fischer-Tropsch reactors are used in the process, the process improvement comprising:

(a) separating Fischer-Tropsch produced water from the Fischer-Tropsch reaction product mixture of a first Fischer-Tropsch reactor; and (b) mixing the separated Fischer-Tropsch water from step (a) with the feed to a second Fischer-Tropsch reactor wherein the second Fischer-Tropsch reactor is the same as the first Fischer-Tropsch reactor or is located upstream of the first Fischer-Tropsch reactor.

13. The process improvement of claim 12 wherein the synthesis gas is produced in the presence of air or oxygen-enriched air.

14. The process improvement of claim 12 wherein the Fischer-Tropsch reactors contain a catalyst comprising cobalt.

15. The process of claim 1 further comprising the steps of:

(f) recovering a first nitrogen-enriches aqueous stream from the first absorber; and (g) recovering a second nitrogen-enriches aqueous stream from the second absorber.

16. The process of claim 16 further comprising the step of mixing the first and second nitrogen-enriched streams together.

17. The process of claim 15 further comprising the step of treating at least one of the first and second nitrogen-enriched streams by removing all or part of the nitrogen contaminants in such stream(s).

18. The process of claim 17 further comprising the step of recycling the treated aqueous stream(s).

19. The process of claim 1 wherein the temperature of at least one of the water stream introduced into the first absorber and the Fischer-Tropsch produced water stream introduced into the second absorber are temperature controlled.

* * * * *